United States Patent [19]

Taylor

[11] Patent Number: 4,886,279

[45] Date of Patent: Dec. 12, 1989

[54] CIRCULAR CHESS/CHECKERS BOARD METHOD OF PLAY

[76] Inventor: William A. Taylor, #10 - 124 Lewis Street, Winnipeg, Manitoba, Canada, R3L 1W9

[21] Appl. No.: 244,293

[22] Filed: Sep. 15, 1988

[51] Int. Cl.[4] ..... A63F 3/02

[52] U.S. Cl. ..... 273/261

[58] Field of Search ..... 273/261; D21/24, 32

[56] References Cited

U.S. PATENT DOCUMENTS

| | | | |
|---|---|---|---|
| D. 226,321 | 2/1973 | Aiuppa | 273/261 |
| D. 231,746 | 6/1974 | Aiuppa | D21/24 |
| 1,295,993 | 3/1919 | Kleissl | 273/261 |
| 3,851,883 | 12/1974 | Hitchcock et al. | 273/261 |
| 3,917,273 | 11/1975 | Blakewood | 273/261 |

*Primary Examiner*—Edward M. Coven
*Assistant Examiner*—Benjamin Layno
*Attorney, Agent, or Firm*—Murray E. Thrift; Stanley G. Ade; Adrian D. Battison

[57] ABSTRACT

A game board for the game of chess and other games such as checkers, consists of four concentric rings of playing areas, the center ring being circular. The center ring has four playing areas, the second ring twelve, the third ring twenty and the fouth ring twenty-eight. The abutting playing areas are of contrasting appearance as is usually the case in a chess board. Four rows of corner playing areas, which may all be trilateral, radiate symmetrically form the center of the board. The outermost corner areas may be other shapes, such as circular or rombic. The remainder of the playing areas are quadrilateral. The board is suitable for playing a conventional game of chess, but also adapts itself well to a slightly modified game where the rook and queen pieces are allowed to travel around the board, moving from rank to file to create a logically valid flanking action and a centrifugal emphasis that is entirely absent in the conventional game.

8 Claims, 6 Drawing Sheets

CIRCULAR CHESS/CHECKERS BOARD METHOD OF PLAY

FIELD OF THE INVENTION

The present invention relates to a game board and to the playing of the game of chess upon such a board.

BACKGROUND OF THE INVENTION

The current theory of the game of chess is that control of the center of the game board is the crucial factor in winning a game. This has the effect of de-emphasizing all flanking maneuvers along the edges of the board and concentrating all of the players efforts on the frontal attack and frontal defence aspects of the game. The conventional square board produces this natural centripetal emphasis in the conventional game.

SUMMARY OF THE INVENTION

The present invention aims at the provision of a novel chess board that may be used to play conventional chess, or to play a slightly modified version of the traditional game, which creates a greater emphasis on play at the edges of the board, and creates a centrifugal emphasis to the game and added possibilities for effective flanking attacks. The centre and both flanks are then all valid attack options.

According to one aspect of the present invention there is provided a game board comprising a plurality of concentric rings, the center ring being a circular circular area, with 8N-4 playing areas in each ring, where N is the number of the ring, counting from the center out, and wherein abutting playing areas are of contrasting appearance.

The circular board is arranged to allow the play of a conventional chess, chequers or the like game. By bending the ranks and files into rings however, a circular motion is brought into the game, bringing the pieces to the outside, near the edges of the board. The effect of this is to psychologically emphasize play at the board edges.

According to another aspect of the present invention there is provided a method for playing a game, said game having a game board with four concentric rings, the center ring being a circle, each ring being marked off symmetrically in 8N-4 playing areas where N is the number of the ring counting from the center outwards, the playing areas including four rows of corner areas radiating symmetrically from the center of the first ring, and abutting playing areas being of contrasting in colors, said method comprising:

arranging a standard set of chess pieces on opposite sides of the board, with each first rank extending along the fourth ring from one corner area to the next adjacent corner area and each second rank starting on the fourth ring adjacent the ends of the associated first rank and extending along the third ring therebetween;

starting and continuing play according to the standard rules of chess, with the king and queen files extending along opposite sides of a diametral line across the board, each bishop file having one playing area at each end in the fourth ring, the next adjacent playing area in the third ring and four adjacent playing areas in the second ring, each knight file having one playing area at each end in the fourth ring and six playing areas in the third ring and each rook file having eight playing areas in the fourth ring, extending from one corner area to the next corner area; and in addition to the standard rules of chess, allowing rook pieces to travel along at least the fourth ring, beyond at least one corner area thereof on a single move.

The additional possibility of having the rook continue around the corner area on the game board allows flanking attacks that are not possible with the conventional chess game. This creates a centrifugal emphasis in the play that balances the usual centripetal emphasis in conventional chess. This in turn allows a player to pursue logical and valid flanking attacks on his opponent. Protection and attack along the rings become much more important factors in the game so that the simulated battle of a chess game more closely resembles the real battles in which the game was originally intended to simulate.

BRIEF DESCRIPTION OF THE DRAWINGS

In the accompanying drawings, which illustrate exemplary embodiments of the present invention.

DETAILED DESCRIPTION

Figure 1:
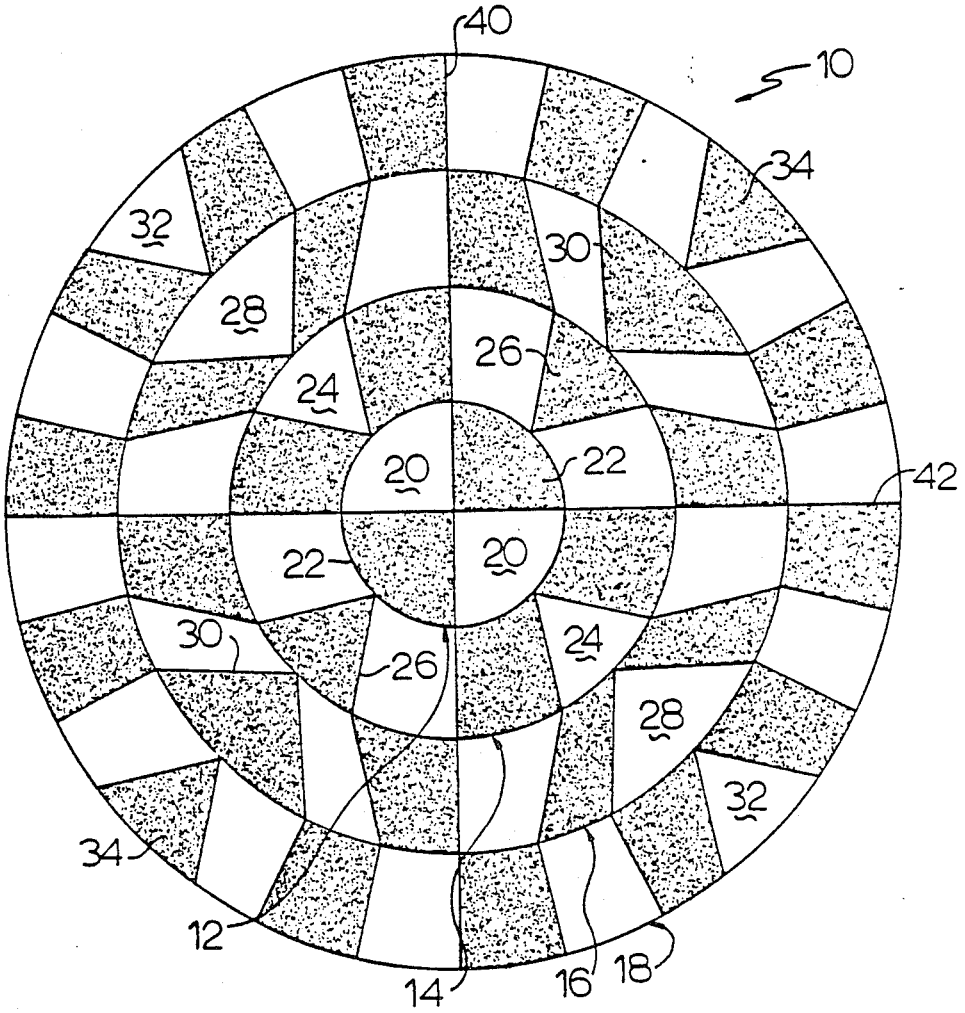
FIG. 1 is a plan view of a game board according to the present invention.
Figure 2:
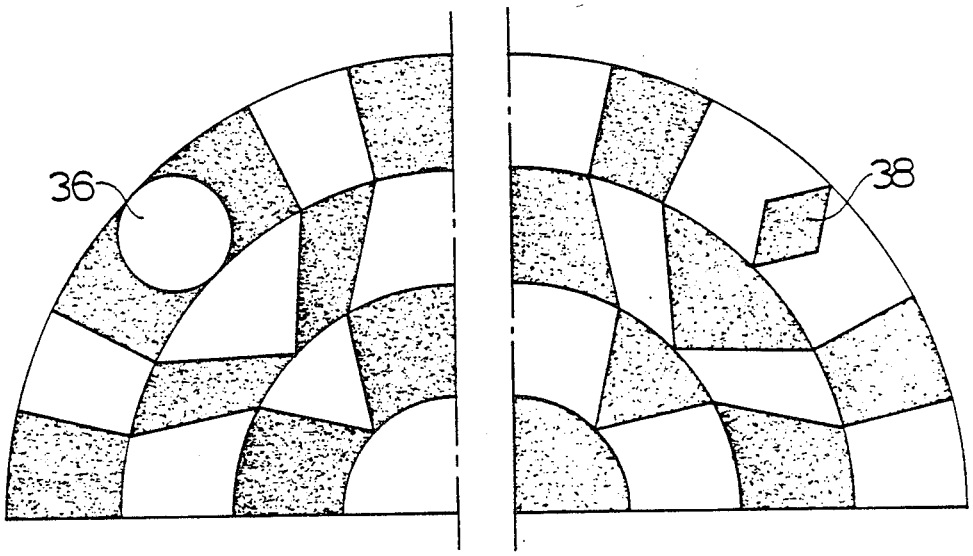
FIG. 2 illustrates quadrants of a board showing different forms for the outer ring corner areas.

Referring to the accompanying drawings, FIG. 1 illustrates a game board 10 consisting of four concentric rings, including a first, inner ring 12 in the form of a circle, a second ring 14, a third ring 16 and a fourth ring 18. The first through fourth rings are marked off in four, twelve, twenty and twenty-eight playing areas respectively, a total of sixty-four as with a conventional chess board. The adjacent playing areas are of contrasting colors such as white and black as on a conventional chess board. It will be noted that the number of playing areas in each ring may be expressed as 8N-4, where N is the number of the ring, counting from the center out. The board includes four rows of trilateral corner playing areas radiating symmetrically from the center of the board. These include white corners 20 and black corners 22 in the first ring, white corners 24 and black corners 26 in the second ring, white corners 28 and black corners 30 in the third ring and white corners 32 and black corners 34 in the fourth ring. The remaining playing areas are all quadrilateral and are arranged symmetrically with respect to the trilateral playing areas and to diametral lines 40 and 42 arranged at 45° to the rows of trilateral areas. FIG. 2 illustrates two alternative board arrangements where the corner areas in the fourth ring are circles 36 or rhombs 38.

Figure 3:
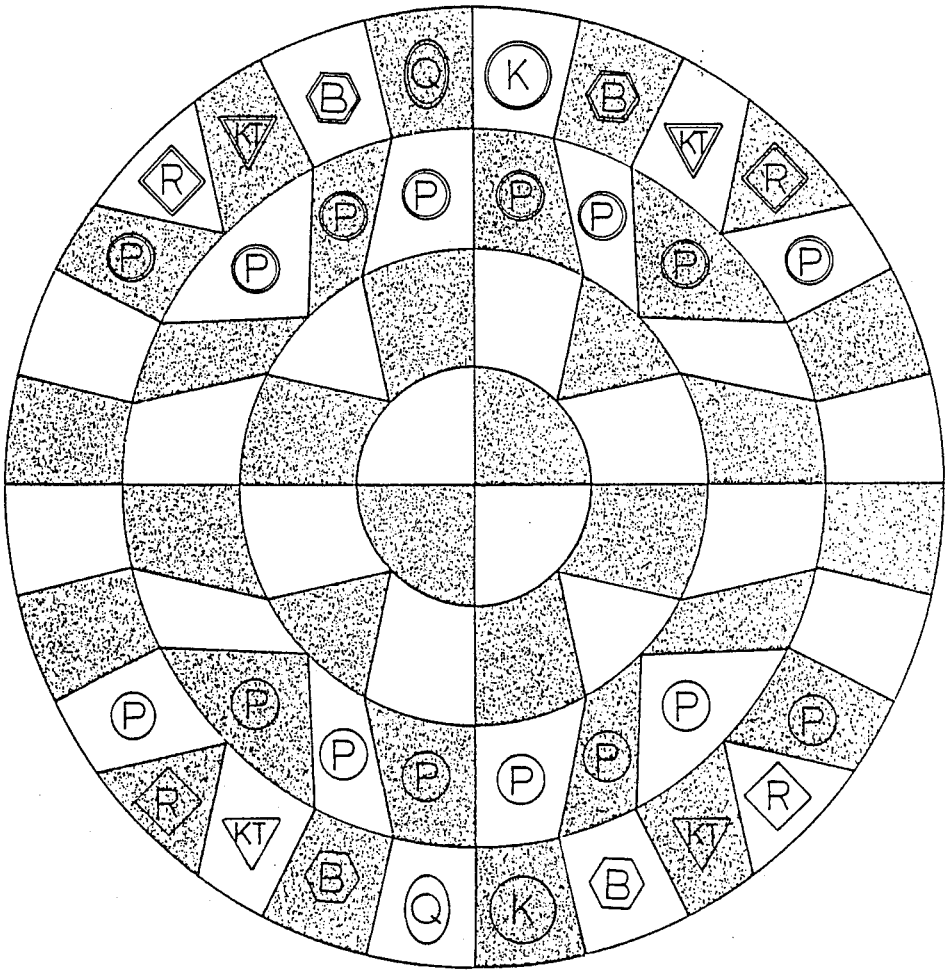
FIG. 3 illustrates a board with the pieces in starting positions.
Figure 4:
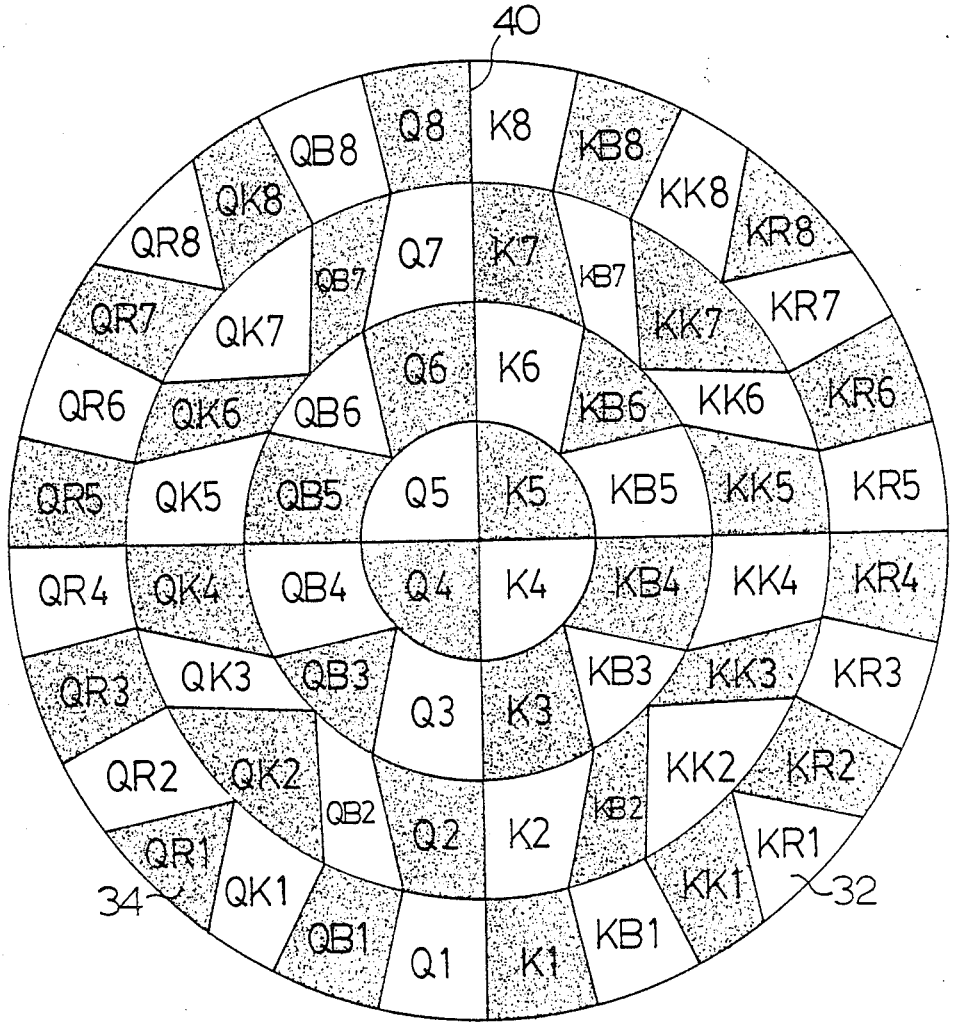
FIG. 4 illustrates a board according to the present invention with the playing areas marked with the notation for white.

In FIG. 3, the board is shown with the pieces in their starting positions. In FIG. 4, the board is marked with the standard chess notation for white. It will be observed that the standard set of chess pieces is arranged on opposite sides of the board, with each first rank extending along the outer ring from a black corner 34 to a white corner 32. The second rank starts on the fourth ring adjacent the ends of the first rank, that is just beyond the corners 32 and 34 and extends between those playing areas along the third ring. The king and queen files extend along opposite sides of the diametral line 40 dividing the board into left and right halves. Each of the bishop files has, at each end, one playing area in the fourth ring, one playing area in the third ring and then a total of four playing areas in the second ring. Each of the knight files has a single playing area at each end in the fourth ring and six playing areas in the third ring. Each of the rook files has all eight spaces in the fourth ring, extending from corner area to corner area. Thus, the board has sixty-four playing areas arranged in the same relationship as the sixty-four squares on a conventional chess board. In this case, however, the ranks and files are curved into a circular configuration which tends physically and psychologically to bring the play to the outside of the board and away from the center.

Figure 5:
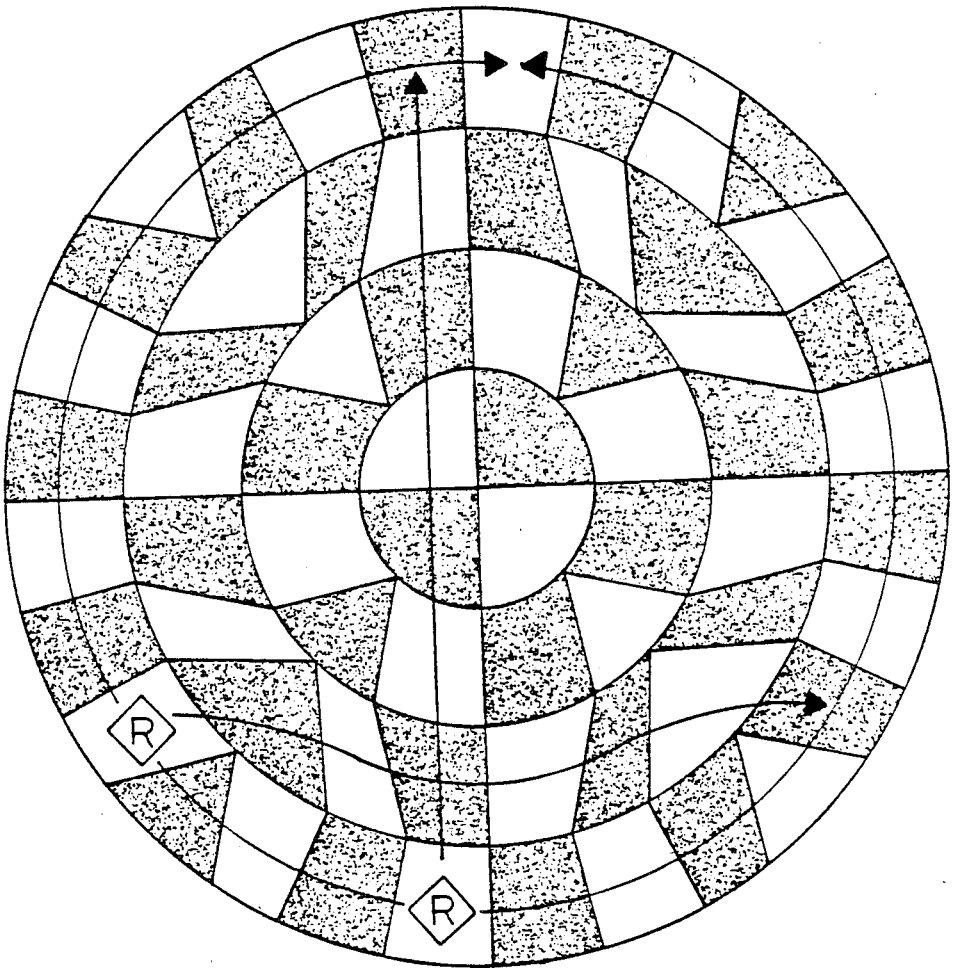
FIG. 5 is a view like FIG. 1 showing the range of movements possible with a rook according to a method of the present invention.

With one minor change in the rules of standard chess, this emphasis on movement to the outside is augmented. This rule change involves allowing the rooks to travel along at least the fourth ring, beyond at least one corner area in each move. It is currently preferred to allow the rooks and queens to travel the full circumference of each ring without impediment. FIG. 5 illustrates the range of movements of the rook with this change. As will be observed, a rook in the first rank may travel beyond the corners of the first rank into the QR or KR files and beyond up to the eighth rank. It is desirable to limit this additional movement of the rook so that a rook that has moved from one ring to another in any move may not subsequently pass a corner playing area. Thus, the rook 44 may pass from QR2 to QK2 and on to KK2 and thence to KR2 to complete the movement along the second rank. Once having moved from the fourth ring to the third ring however, it may not then continue on the third ring beyond KK2. A movement beyond KK2 in the third ring would be possible where at the beginning of the move the rook was in the third ring.

Figure 6:
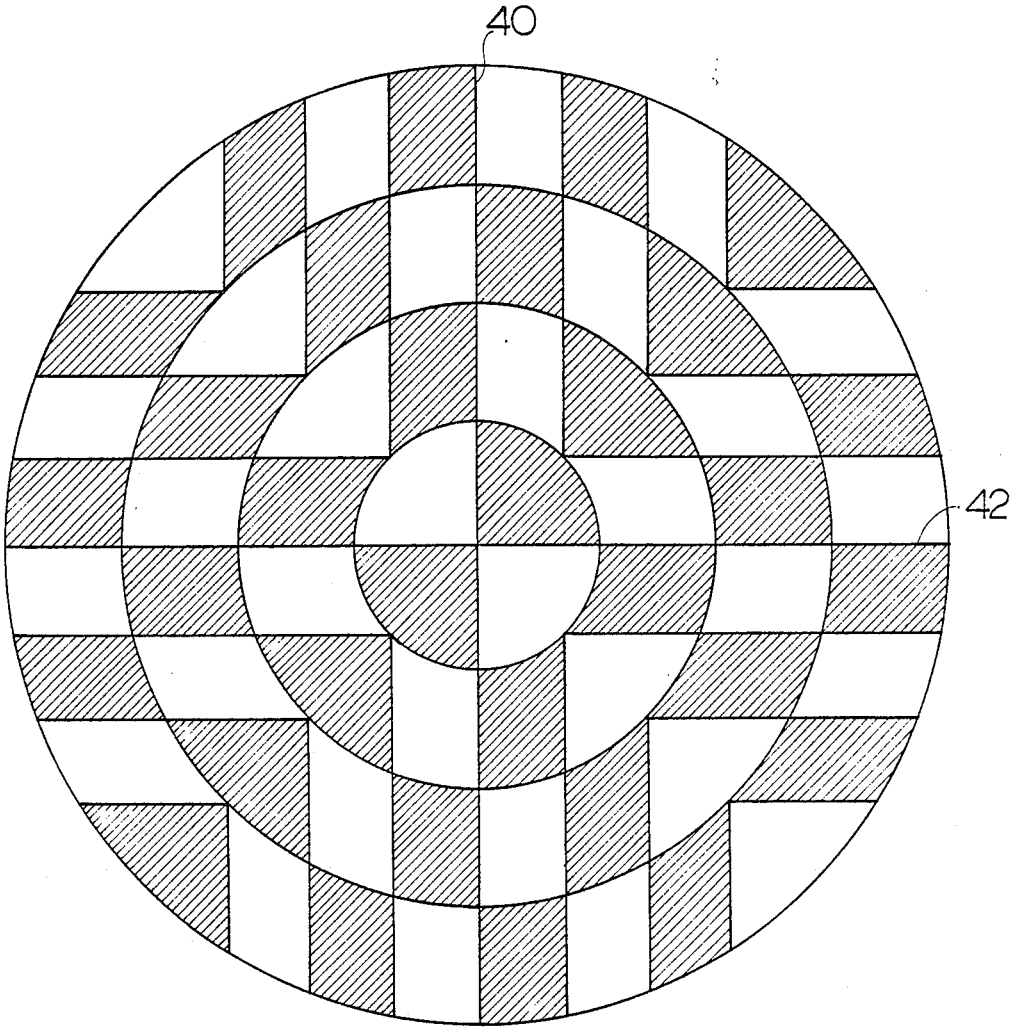
FIG. 6 is an alternative embodiment of the board.

An alternative embodiment of the board is illustrated in FIG. 6, where each of the corner areas has a right-angled apex with sides parallel to the diametral lines 40 and 42. The sides of the other areas, other than those bounded by the circular edges of the rings, aligned with the corner area edges, providing the board with a somewhat more conventional appearance.

While certain embodiments of the game board and a particular embodiment of a modified game of chess suitably played with the game board have been described in the foregoing, it is to be understood that the invention is not to be considered limited by the foregoing description. The invention is to be considered limited solely by the scope of the appended claims.

I claim:

1. A method for playing a game, said game having a game board with four concentric rings, the center ring being a circle, each ring being marked off symmetrically in 8N-4 playing areas where N is the number of the ring counting from the center outwards, the playing areas including four rows of corner areas radiating symmetrically from the center of the first ring, and abutting playing areas being of contrasting colors, said method comprising:

arranging a standard set of chess pieces on opposite sides of the board, with each first rank extending along the fourth ring from one corner area to the next adjacent corner area and each the second rank starting on the fourth ring adjacent the ends of the associated first rank and extending along the third ring therebetween;

starting and continuing play according to the standard rules of chess, with the king and queen files extending along opposite sides of a diametral line across the board, each bishop file having one playing area at each end in the fourth ring, the next adjacent playing area in the third ring and four adjacent playing areas in the second ring, each knight file having one playing area at each end in the fourth ring and six playing areas in the third ring and each rook file having eight playing areas in the fourth ring, extending from one corner area to the next corner area; and in addition to the standard rules of chess, allowing rook pieces to travel along at least the fourth ring, beyond at least one corner area thereof on a single move.

2. A method according to claim 1 including preventing the rook pieces from passing a second corner area in a ring during a move involving movement of the rook piece from one ring to another.

3. A method according to claim 2 including allowing each rook piece to travel along each ring, beyond each corner area thereof.

4. A method according to claim 1 including allowing each rook piece to travel along each ring, beyond each corner area thereof.

5. A method according to claim 1 including allowing queen pieces to travel along at least the fourth ring, beyond at least one corner area thereof on a single move.

6. A method according to claim 5 including preventing the queen and rook pieces from passing a second corner area in a ring during a move involving movement of the piece from one ring to another.

7. A method according to claim 6, including allowing each queen and rook piece to travel along each ring, beyond each corner area thereof.

8. A method according to claim 5, including allowing each queen and rook piece to travel along each ring, beyond each corner area thereof.

* * * * *